US010405725B2

(12) United States Patent
Roderick et al.

(10) Patent No.: US 10,405,725 B2
(45) Date of Patent: Sep. 10, 2019

(54) DISHWASHER WITH HYDRAULICALLY POWERED WASH SYSTEM

(71) Applicant: Whirlpool Corporation, Benton Harbor, MI (US)

(72) Inventors: Frederick T. Roderick, Coloma, MI (US); Antony M. Rappette, Benton Harbor, MI (US); Daniel Lottinville, Benton Harbor, MI (US); David Brightbill, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/050,146

(22) Filed: Jul. 31, 2018

(65) Prior Publication Data

US 2018/0333037 A1 Nov. 22, 2018

Related U.S. Application Data

(63) Continuation of application No. 15/075,552, filed on Mar. 21, 2016, now Pat. No. 10,064,536.

(51) Int. Cl.

| | |
|---|---|
| ***A47L 15/22*** | (2006.01) |
| ***A47L 15/42*** | (2006.01) |
| ***A47L 15/50*** | (2006.01) |

(52) U.S. Cl.

CPC ..... *A47L 15/22* (2013.01); *A47L 15/428* (2013.01); *A47L 15/4225* (2013.01); *A47L 15/4261* (2013.01); *A47L 15/4278* (2013.01); *A47L 15/4285* (2013.01); *A47L 15/4287* (2013.01); *A47L 15/4293* (2013.01); *A47L 15/4297* (2013.01); *A47L 15/507* (2013.01)

(58) Field of Classification Search

CPC .. A47L 15/22; A47L 15/4225; A47L 15/4261; A47L 15/4278; A47L 15/428; A47L 15/4285; A47L 15/4287; A47L 15/4293; A47L 15/4297; A47L 15/507

USPC ..... 134/25.2, 56 D, 57 D, 58 D

See application file for complete search history.

(56) References Cited

U.S. PATENT DOCUMENTS

| | | | |
|---|---|---|---|
| 3,176,697 | A | 4/1965 | Gibson |
| 3,210,010 | A | 10/1965 | Delapena |
| 4,298,015 | A | 11/1981 | Garza |
| 4,405,087 | A | 9/1983 | Mata-Garza |

FOREIGN PATENT DOCUMENTS

| | | | |
|---|---|---|---|
| CN | 204467992 | U | 7/2015 |
| DE | 202004013786 | U1 | 12/2004 |
| EP | 0321025 | A2 | 6/1989 |

*Primary Examiner* — Levon J Shahinian

(74) *Attorney, Agent, or Firm* — McGarry Bair PC

(57) ABSTRACT

A dishwasher for treating dishes according to a cycle of operation includes a tub at least partially defining a treating chamber, a liquid supply conduit, and a rotatable sprayer that is rotatable about a rotation axis and has an inlet and multiple nozzles collectively forming an outlet. The dishwasher further includes a hydraulic drive fluidly coupling the liquid supply conduit to the rotatable sprayer. The hydraulic drive is mechanically coupled to the rotatable sprayer.

14 Claims, 4 Drawing Sheets

DISHWASHER WITH HYDRAULICALLY POWERED WASH SYSTEM

CROSS-REFERENCE TO RELATED APPLICATION(S)

This application claims priority to and is a continuation of U.S. patent application Ser. No. 15/075,552, filed Mar. 21, 2016, now U.S. Pat. No. 10,064,536, issued Sep. 4, 2018, which is incorporated herein by reference in its entirety.

BACKGROUND OF THE INVENTION

Contemporary automatic dishwashers for use in a typical household include a tub and at least one rack or basket for supporting soiled dishes within the tub. At least an upper rack and a lower rack for holding dishes to be cleaned are typically provided within the treating chamber. A silverware basket for holding utensils, silverware, etc. is also usually provided and normally removably mounts to the door or within the lower rack.

A spraying system can be provided for recirculating liquid throughout the tub to remove soils from the dishes. The spraying system can include various sprayers, including one or more rotatable tube wash systems. Powering and driving the rotation in a tube wash manifold can be a significant contributor to the cost and complexity of the wash system within a dishwasher.

BRIEF DESCRIPTION OF THE INVENTION

In one aspect, A method of rotating a rotatable sprayer in a tub of a dishwasher, the method comprising: supplying wash liquid to the rotatable sprayer; splitting the supplied was liquid into a fluidly isolated first and second portions; supplying the first portion to the rotatable sprayer where the first portion is emitted through the rotatable sprayer; and supplying the second portion to a rotatable turbine that is rotationally coupled to the rotatable sprayer, whereby the wash liquid effects rotation of the turbine to rotate the rotatable sprayer.

DETAILED DESCRIPTION OF EMBODIMENTS OF THE INVENTION

Figure 1:
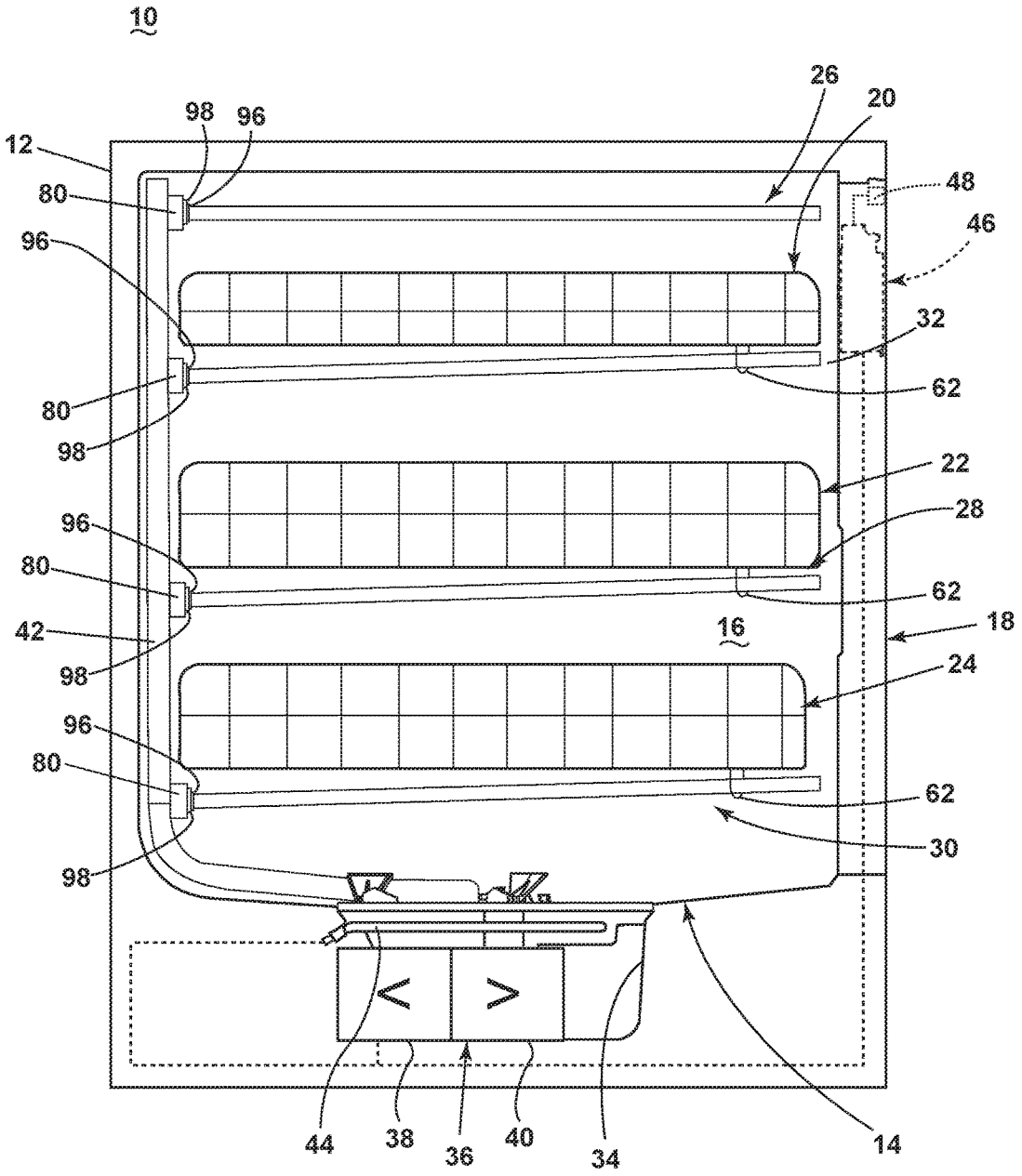
FIG. 1 illustrates a schematic, cross-sectional view of a dishwasher with a spraying system according to an embodiment of the invention.

FIG. 1 illustrates a schematic, cross-sectional view of an exemplary automated dishwasher 10 according to an embodiment of the invention. The dishwasher 10 shares many features of a conventional automated dishwasher, which will not be described in detail herein except as necessary for a complete understanding of the invention. A chassis 12 can define an interior of the dishwasher 10 and can include a frame, with or without panels mounted to the frame. For built-in dishwashers, outer panels are typically not needed. For dishwashers that are not built into existing cabinetry, the chassis 12 can include the panels mounted to the frame to form a cabinet for the dishwasher 10. An open-faced tub 14 can be provided within the chassis 12 and can at least partially define a treating chamber 16 for washing or otherwise treating dishes. The open face of the tub 14 defines an access opening for the treating chamber 16.

A closure element, such as a door assembly 18, can be movably mounted to the dishwasher 10 for movement between opened and closed positions to selectively open and close the treating chamber access opening defined by the open face of the tub 14. Thus, the door assembly 18 provides accessibility to the treating chamber 16 for the loading and unloading of dishes or other washable items. It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open. Alternatively, the closure element can be slidable relative to the chassis 12, such as in a drawer-type dishwasher, wherein the access opening for the treating chamber 16 is formed by an open-top tub. Other configurations of the closure element relative to the chassis 12 and the tub 14 are also within the scope of the invention.

Dish holders, illustrated in the form of upper, middle, and lower dish racks 20, 22, 24, can be located within the treating chamber 16 and receive dishes for treatment, such as washing. The upper, middle, and lower racks 20, 22, 24 are typically mounted for slidable movement in and out of the treating chamber 16 for ease of loading and unloading. Other dish holders can be provided, such as a silverware basket, separate from or integral with any of the upper, middle, and lower racks 20, 22, 24. As used in this description, the term "dish(es)" is intended to be generic to any item, single or plural, that may be treated in the dishwasher 10, including, without limitation, dishes, plates, pots, bowls, pans, glassware, and silverware. While the dishwasher 10 is illustrated herein as having three dish racks 20, 22, 24, it will be understood that any suitable number and configuration of dish racks is also within the scope of the invention.

A spray system can be provided for spraying liquid in the treating chamber 16 and can be provided, for example, in the form of rotatable sprayers, illustrated herein as an upper rotatable sprayer 26, an upper middle rotatable sprayer 32, a lower middle rotatable sprayer 28, and a lower rotatable sprayer 30. The upper rotatable sprayer 26, the upper middle rotatable sprayer 32, and the lower middle rotatable sprayer 28 are located, respectively, above the upper rack assembly 20, above the middle rack assembly 22, and above the lower rack assembly 24. The lower rotatable sprayer 30 is located beneath the lower rack assembly 24. By example, the illustrated rotatable sprayers 26, 28, 30, 32 each include a connector 96 located at the rear end of the rotatable sprayer 26, 28, 30, 32 and adapted to mate or dock with a header 98 that is provided on a manifold 80. The manifold 80 can be mounted at the rear of the tub 14, such as to a liquid supply conduit 42, or in any other suitable location.

It will be further understood that the rotatable sprayers 26, 28, 30, 32, while illustrated as being positioned beneath a central region of the dish racks 20, 22, 24, can also be provided adjacent the opposing walls of the tub 14. Further, at least two of the rotatable sprayers 26, 28, 30, 32 can be adjacent different ones of the at least two opposing walls of the tub 14, even being provided in such a configuration that the at least two rotatable sprayers 26, 28, 30, 32 are provided adjacent opposing side walls as well as adjacent to the bottom of the same dish rack 20, 22, 24. It will also be understood that each of the levels of rotatable sprayers 26, 28, 30, 32 can comprise multiple rotatable sprayers 26, 28, 30, 32 provided in parallel with one another and spread out horizontally across the width of the manifold 80, which can extend generally from one side wall to another side wall of the tub 14.

The rotatable sprayers 26, 28, 30, 32 can be provided at an angle relative to the rack assemblies 20, 22, 24. In an exemplary embodiment, a front or second end of the rotatable sprayer 26, 28, 30, 32 can be positioned in a higher position than the first or rear end of the rotatable sprayer 26, 28, 30, 32 where the connector 96 is located. While the rotatable sprayers 28, 30, 32 are illustrated herein as being positioned at an angle, it will be understood that the angle of the rotatable sprayers 26, 28, 30, 32 can be any suitable angle relative to the plane of the rack assemblies 20, 22, 24, including a zero degree angle, or the rotatable sprayers 26, 28, 30, 32 can be provided in a horizontal position at a 90 degree angle. Further, the rotatable sprayers 26, 28, 30, 32 need not be provided at identical angles, and any combination of angles of the rotatable sprayers 26, 28, 30, 32 is also within the scope of the invention.

The rotatable sprayers 26, 28, 30, 32 are illustrated as spray tubes by example but are not limited to only tubes. For example, the rotatable sprayers 26, 28, 30, 32 could comprise a combination of rotating spray arms and rotating or stationary spray tubes. Furthermore, the spray system can include additional and/or alternative spray assemblies. For example, a distribution header or spray manifold can be located at the rear of the tub 14 at any vertical position. An exemplary spray manifold is set forth in detail in U.S. Pat. No. 7,594,513, issued Sep. 29, 2009, and titled "Multiple Wash Zone Dishwasher," which is incorporated herein by reference in its entirety.

A recirculation system can be provided for recirculating liquid from the treating chamber 16 to the spray system. The recirculation system can include a sump 34 and a pump assembly 36. The sump 34 collects the liquid sprayed in the treating chamber 16 and can be formed by a sloped or recess portion of a bottom wall of the tub 14. The pump assembly 36 can include both a drain pump 38 and a recirculation pump 40. The drain pump 38 can draw liquid from the sump 34 and pump the liquid out of the dishwasher 10 to a household drain line (not shown). The recirculation pump 40 can draw liquid from the sump 34, and the liquid can be simultaneously or selectively pumped through a liquid supply conduit 42, into the manifold 80, and then distributed to each of the rotatable sprayers 26, 28, 30, 32 for selective spraying. The liquid supply conduit 42 and manifold 80 extend along a wall of the tub 14 and fluidly connect the pump assembly 36 to the at least one rotatable sprayer 26, 28, 30, 32.

While not shown, a liquid supply system can include a water supply conduit coupled with a household water supply for supplying water to the treating chamber 16. A heating system including a heater 44 can be located, for example, within the sump 34 for heating the liquid contained in the sump 34.

A control system including a controller 46 can also be included in the dishwasher 10, which can be operably coupled with various components of the dishwasher 10 to implement a cycle of operation. The controller 46 can be located within the door assembly 18 as illustrated, or it can alternatively be located somewhere within the chassis 12. The controller 46 can also be operably coupled with a control panel or user interface 48 for receiving user-selected inputs and communicating information to the user. The user interface 48 can include operational controls such as dials, lights, switches, and displays enabling a user to input commands, such as a cycle of operation, to the controller 46 and receive information.

Figure 2:
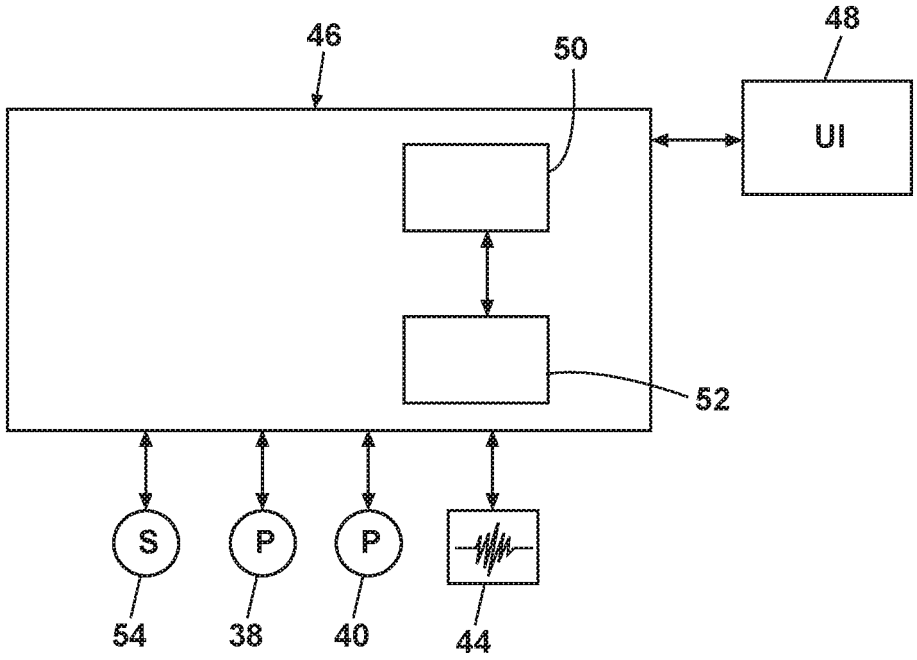
FIG. 2 illustrates a schematic view of a control system for the dishwasher of FIG. 1.

As illustrated schematically in FIG. 2, the controller 46 can be coupled with the heater 44 for heating the wash liquid during a cycle of operation, the drain pump 38 for draining liquid from the treating chamber 16, and the recirculation pump 40 for recirculating the wash liquid during the cycle of operation. The controller 46 can be provided with a memory 50 and a central processing unit (CPU) 52. The memory 50 can be used for storing control software that can be executed by the CPU 52 in completing a cycle of operation using the dishwasher 10 and any additional software. For example, the memory 50 can store one or more pre-programmed cycles of operation that can be selected by a user and completed by the dishwasher 10. The controller 46 can also receive input from one or more sensors 54. Non-limiting examples of sensors that can be communicably coupled with the controller 46 include a temperature sensor and turbidity sensor to determine the soil load associated with a selected grouping of dishes, such as the dishes associated with a particular area of the treating chamber 16.

The dishwasher 10 can include all of the above exemplary systems, a selection of the above exemplary systems, and/or other systems not listed above as desired. Further, some of the systems can be combined with other systems and/or can share components with other systems. Examples of other systems that the dishwasher can further include are a dispensing system that supplies one or more treating agents or chemistries to the treating chamber 16 and an air supply system that may provide air, which can be heated or not heated, to the treating chamber 16, such as for drying and/or cooling the dishes. An exemplary air supply system is set forth in U.S. patent application Ser. No. 12/959,673, filed Dec. 3, 2010 and published as U.S. Patent Application Publication No. 2012/0138106 on Jun. 7, 2012, both of which are incorporated herein by reference in their entireties.

Figure 3:
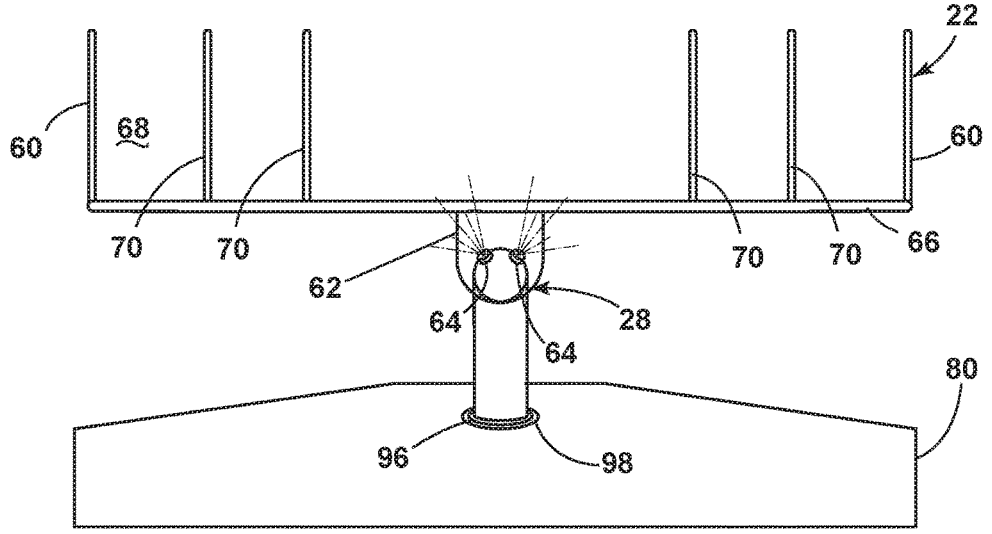
FIG. 3 illustrates a schematic front view of a dish rack and rotatable spray tube for use in the dishwasher of FIG. 1.

Referring now to FIG. 3, a front view of an exemplary dish rack 22 and rotatable sprayer 28 is illustrated. The dish rack 22 can be constructed of a wire frame effectively forming opposing side walls 60, front and rear walls (not shown), and a bottom wall 66 that together define an open-top holding compartment 68. The bottom wall 66 can be completely flat, as illustrated by example, to form a flat bottom dish rack or it can have a varied configuration comprising a plurality of inclined and, possibly, flat walls that effectively forms an overall horizontal bottom of an inclined bottom. Additionally, a plurality of supports 70, such as panels, tines, or other structures, can extend upwardly from the bottom wall 66 and/or the side walls 60, or the front and rear walls (not shown) to support various dish items.

The dish rack 22 can be equipped with the rotatable sprayer 28 adapted to provide treating liquid to dish items placed on the dish rack 22. The rotatable sprayer 28 can be selectively rotatable about a rotation axis. In an exemplary embodiment, the rotatable sprayer 28 has a longitudinal axis which is the axis about which the rotatable rotatable sprayer 28 is selectively rotatable. By rotating the rotatable sprayer 28, the treating liquid can be sprayed in multiple spray angles and trajectories. Rotation of the rotatable sprayer 28 can be driven by a single drive mechanism that is coupled directly to the rotatable sprayer 28. It will also be understood that rotations of a plurality of rotatable sprayers 26, 28, 30, 32 can be driven concurrently by a single unified drive mechanism that can control the rotation of multiple rotatable sprayers 26, 28, 30, 32 by the use of, for example, a series of gears that connects the rotatable sprayers 26, 28, 30, 32 and drives them all to rotate in parallel. The mechanism or actuator for driving the rotation of the rotatable sprayers 26, 28, 30, 32, either in series or individually, can be any suitable driving mechanism, non-limiting examples of which include an electric or hydraulic motor selectively operable to directly drive rotation of one or more rotatable sprayers 26, 28, 30, 32 or a gear assembly, which could be provided in the form of a worm gear assembly, spur gears, etc. Nozzles 64 on the rotatable sprayer 28 may be oriented such that the spray itself may cause the rotatable sprayer 28 to rotate.

The dish rack 22 can be provided with an attachment mechanism 62 that extends downwardly from the bottom wall 66 of the dish rack 22 to attach to and support the rotatable sprayer 28. The attachment mechanism 62 can be any suitable shape that provides support for the front end of the rotatable sprayer 28 and allows for selective rotation of the rotatable sprayer 28. Non-limiting examples of such an attachment mechanism include a hook, a hanger, a bracket, etc.

The rotatable sprayer 28 can be fixedly mounted to the dish rack 22 by the attachment mechanism 62 for movement therewith when the dish rack 22 is slid relative to the tub 14, or the rotatable sprayer 28 can be fixedly mounted to the tub 14 so as to retain its position relative to the tub 14 upon movement of the dish rack 20. In the former case, the rotatable sprayer 28 can dock with the liquid supply conduit 42 (FIG. 1) or other structure of the liquid supply and/or recirculation systems, such as the manifold 80, when the dish rack 22 is slid to its most rearward position in the tub 14 to establish fluid communication with the liquid supply and/or recirculation systems. By example, the connector 96 (FIG. 1) located at the rear end of the rotatable sprayer 28 can be adapted to mate or dock with the header 98 (FIG. 1) provided on the manifold 80. The manifold 80 can be adapted to selectively mate or dock with the liquid supply conduit 42.

The rotatable sprayer 28 can be provided with a plurality of spray nozzles 64 that collectively form an outlet of the rotatable sprayer 28. The spray nozzles 64 can be positioned to spray treating liquid onto the dish items contained within the holding compartment 68 of the dish rack 22. The spray nozzles 64 can be provided along the length of the rotatable sprayer 28 in any suitable configuration, which can be linear or non-linear. The nozzles 64 can be provided on the surface of the rotatable sprayer 28, or they can be indented or recessed into the surface of the rotatable sprayer 28. The volume and velocity of the treating liquid emitted from the spray nozzles 64 can be based on the type of dish item contained within the dish rack 22, can be generic for all types of dish items, and/or can be variable from one treating cycle of operation to another and/or within a single treating cycle of operation. Additionally, the spray nozzles 64 can spray liquid alternately (e.g., between rows—one row at a time wherein the rows are sequenced on and off, within rows—sets of nozzles 64 within a row sequenced on and off), continuously, and/or intermittently.

Figure 4:
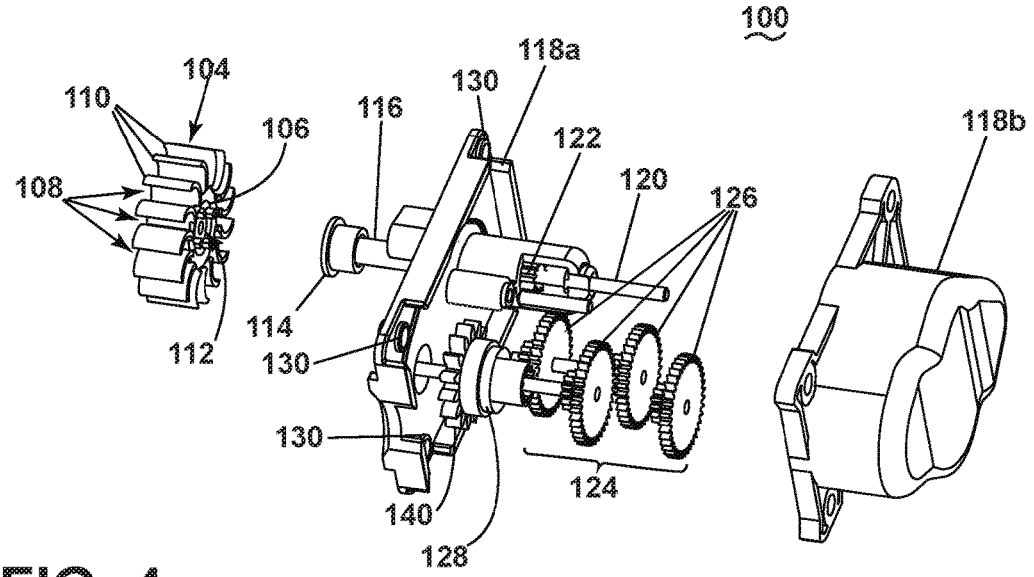
FIG. 4 illustrates an exploded view of a hydraulic drive for effecting rotation of the rotatable sprayer of FIG. 3.

FIG. 4 illustrates an exploded view of a hydraulic drive 100 that can affect the rotation of the rotatable sprayer 28 of FIG. 3 according to an embodiment of the invention. The hydraulic drive 100 can be provided as an independent module that can be placed on any tube wash manifold 80 within a dishwasher 10. The hydraulic drive 100 fluidly couples the liquid supply conduit 42 to the inlet 102 (FIG. 6) of the rotatable sprayer 28. More specifically, the hydraulic drive 100 comprises a rotatable turbine 104 that is mechanically coupled to the rotatable sprayer 28 such that liquid supplied from the liquid supply conduit 42 via the manifold 80 rotates the rotatable turbine 104 to effect the rotation of the rotatable sprayer 28. In an exemplary embodiment, the rotatable turbine 104 can be an impulse turbine 104. It will be understood that a different type of turbine 104 could also be suitably employed within the hydraulic drive 100, non-limiting examples of which include a reaction turbine, Archimedes turbine, or any other suitable paddle wheel shape.

The impulse turbine 104 comprises a runner 106 that is located at the center of the impulse turbine 104, as well as a plurality of circumferentially spaced buckets 108, which are at least partially defined by a plurality of curved vanes 110. The buckets 108 are positioned radially outward of and circumferentially surrounding the runner 106. The buckets 108 have a curved bottom, illustrated herein as a vane 110, with radial inner ends **108*a* (FIG. 5) positioned nearest the runner 106 and radial outer ends 108*b* (FIG. 5) positioned furthest from the runner 106. The buckets 108 have no sides, such that fluid is able to flow freely out of the buckets 108 to the sides. The impulse turbine 104 further includes a shaft hole 112 that can have any suitable diameter such that the impulse turbine 104 can be pressed onto a drive shaft 120. The quantity of vanes 110 and buckets 108 that make up the impulse turbine 104 can be any number that is suitable to the mechanical constraints and performance requirements of the hydraulic drive 100. The diameter of the impulse turbine 104 can be any suitable size that is within the spatial limits of the system clearance of the dishwasher 10**.

The impulse turbine 104 interfaces with and forms a friction surface against a bushing 114. The bushing 114 can act as a wear surface for the impulse turbine 104, as well as the drive shaft 120. The bushing 114 can have an inner geometry (not shown) that serves to minimize contact with the drive shaft 120, or can be formed as a tapered cylinder. In an exemplary embodiment, the bushing 114 is formed of a low friction material, such as, but not limited to, acetal. The bushing 114 is further provided with a spacer 116 that serves to provide the desired spacing between the impulse turbine 104 and a drive gear 122, which are operably coupled via the drive shaft 120. The bushing 114 inserts into a first housing portion **118*a*. The first housing 118*a* also supports and centers the drive shaft 120. It is within the scope of the invention that the bushing 114 and the spacer 116 can be separate pieces that are held together by an attachment means, or that the bushing 114 and the spacer 116 can be molded as one part. It is also contemplated that the impulse turbine 104 and drive gear 122 can be molded or over-molded onto the drive shaft 120. The drive shaft 120 can alternatively be provided with a groove (not shown) at the end furthest from the impulse turbine 104 which can mate with a tongue and groove feature on the inner diameter of the drive gear 122, eliminating the need to press or mold the drive gear 122 onto the drive shaft 120 after the bushing 114 and spacer 116. The drive shaft 120** can be formed of any suitable material, including, but not limited to, a metal, a plastic, or other suitable low friction material.

The drive shaft 120 may be a separate piece, but is operably connected to the impulse turbine 104. The end of the drive shaft 120 nearest the impulse turbine 104 can be formed with a geometry that allows the drive shaft 120 to be effectively pressed and inserted into the shaft hole 112 of the impulse turbine 104 and serves to prevent the impulse turbine 104 from slipping or having a loose connection about the drive shaft 120. The opposite end of the drive shaft 120, located furthest from the impulse turbine 104 passes through the bushing 114, spacer 116, and drive gear 122, terminating at a second housing portion 118*b*.

The drive gear 122 can be further operably coupled to a gear train 124 that serves to couple the impulse turbine 104 to the rotatable sprayer 28. In an exemplary embodiment, the gear train 124 is a gear reducing gear train 124 comprising a plurality of reduction gears 126. The reduction gears 126 can be any suitable type of gears that allow for efficient energy transfer, including, but not limited to, compound spur gears. The teeth of the reduction gears 126 can be undercut to allow for a spacing tolerance between adjacent reduction gears 126. By non-limiting example, the spacing tolerance could be +/−0.2 millimeters.

Figure 6:
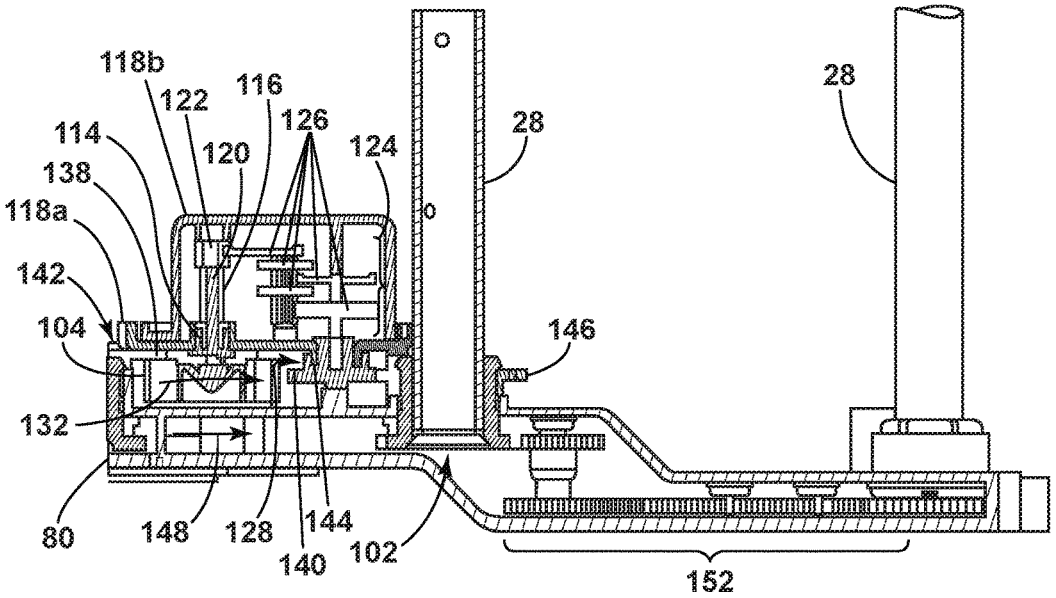
FIG. 6 illustrates a schematic cross-sectional view of the coupling of the hydraulic drive of FIG. 4 with the rotatable tube of FIG. 3.

The gear train 124 can be further operably coupled to an output gear 128 that passes through the first housing portion 118*a*. An outer portion 140 of the output gear 128 that is positioned externally to the first housing portion 118*a* has a toothed surface. The toothed outer portion 140 of the output gear 128 can be operably coupled with a toothed ring 146 (FIG. 6) that is provided about the rotatable sprayer 28 in order to effect the rotation of the rotatable sprayer 28. The output gear 128 can have an undercut profile to allow for movement within the first housing portion 118*a*. The inner cylindrical surface of the output gear 128 can have a tongue and groove feature to define a tortuous path 144 (FIG. 6) in order to deter the transmission of liquid from the output gear 128 into the first housing portion 118*a*. The output gear 128 also allows for a spacing tolerance with adjacent gears, such as the toothed ring 146 (FIG. 6). The spacing tolerance can be larger for the output gear 128 than for the reduction gears 126. By non-limiting example, a spacing tolerance of +/−0.5 millimeters is contemplated.

The first housing portion 118*a* and second housing portion 118*b* can be combined to be collectively thought of as a single unit housing 118, which can be a gear box structure. In the exemplary embodiment illustrated herein, the impulse turbine 104 is located outside of the housing 118, while the gear train 124 is located within the housing 118. The first housing portion 118*a* can have molded tabs 130. The molded tabs 130 allow the first housing portion 118*a* to insert into and attach to a tube wash manifold 80, for example, by the use of screws or other fasteners. The molded tabs 130 also allow for alignment and attachment of the first housing portion 118*a* with the second housing portion 118*b*. It is contemplated that the first and second housing portions 118*a*, 118*b* can be attached by any suitable joining mechanism, non-limiting examples of which include a snap-fit connection or the use of screws or other suitable fasteners. It is further contemplated that the perimeter of the first and second housing portions 118*a*, 118*b* can have a water-tight connection. This water-tight connection can be accomplished by, for example, a tongue and groove feature or the use of a gasket or seal. It is contemplated that the second housing portion 118*b* can be formed of any suitable low friction material, such as, but not limited to, polypropylene.

Figure 5:
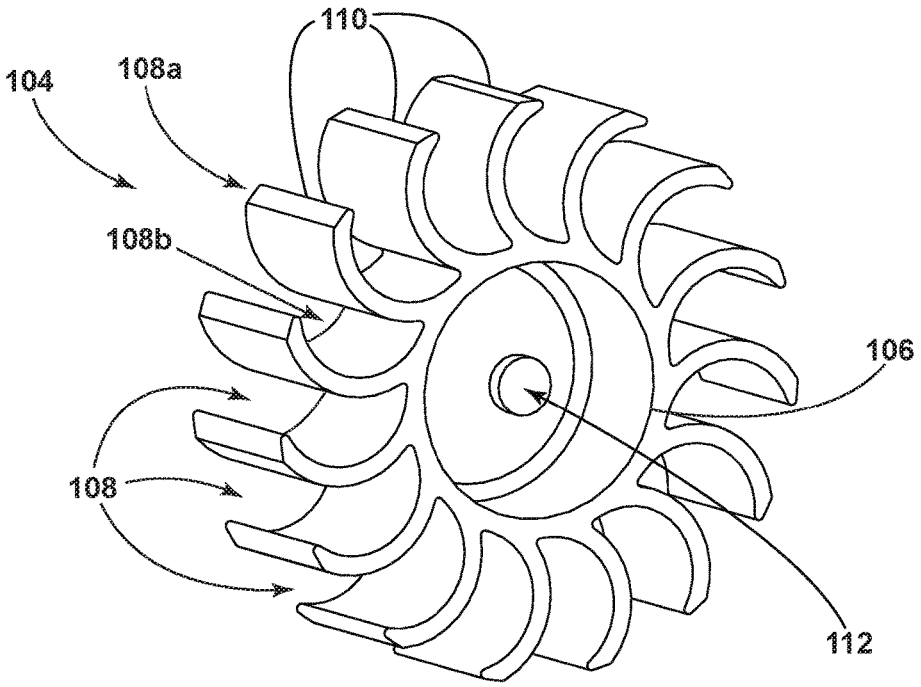
FIG. 5 illustrates an enlarged perspective view of a rotatable turbine for use in the hydraulic drive of FIG. 4.

FIG. 5 illustrates an enlarged perspective view of an exemplary embodiment of the impulse turbine 104 of FIG. 4, the structure of which will be described herein in further detail. The curved bottoms of the buckets 108, defined by the vanes 110, have a radial inner end 108*b* and a radial outer end 108*a*. The curvature of the vanes 110 is selected in order to maximize the transfer of energy from wash liquid contacting the vanes 110 to drive rotation of the impulse turbine 104 as described above. The width between the vanes 110 is also selected to maximize energy transfer from the wash liquid while minimizing the effects of inertia on the start-up torque of the impulse turbine 104. The number of vanes 110 is selected in order to maintain the force from the wash liquid as it transfers to the next vane 110 as the impulse turbine 104 rotates.

FIG. 6 illustrates a schematic view of a coupling between the impulse turbine 104 and a rotatable sprayer 28 of the hydraulic drive 100. The hydraulic drive 100 comprises a housing portion 138 of the manifold 80 that encloses the impulse turbine 104. The first housing portion 118*a* can be attached to a rear surface 142 of the manifold 80. The toothed outer portion 140 of the output gear 128 that is located externally to the first housing portion 118*a* would then be located adjacent the rear surface 142 of the manifold 80, and would be positioned laterally in between the impulse turbine 104 and the rotatable sprayer 28, adjacent the rear surface 142 of the second housing 138. This positioning allows the rotation of the output gear 128 to be effected by rotation of the impulse turbine 104, and also allows for the mechanical coupling of the toothed outer portion 140 of the output gear 128 with the toothed ring 146 provided about the rotatable sprayer 28 as described above.

Turning now to the method of rotating the rotatable sprayer 28 by the operation of the hydraulic drive 100, wash liquid is supplied to the rotatable sprayer 28 from the liquid supply conduit 42 via the manifold 80, along a flow path indicated by the arrow 148. As the wash liquid flows through the manifold 80 toward the rotatable sprayer 28, a portion of the wash liquid flows in an alternate flow path, through a nozzle (not shown) and over the rotatable impulse turbine 104. The wash liquid can be allowed to flow freely over the impulse turbine 104 from the manifold 80, or it can flow through at least one nozzle (not shown) that serves to emit the wash liquid directly onto the impulse turbine 104, and, more specifically, onto the buckets 108 of the impulse turbine 104. The nozzle (not shown) can have an inlet fluidly coupled to the manifold 80 and an outlet oriented to direct a spray of wash liquid onto the impulse turbine 104. The force from the wash liquid being emitted onto the impulse turbine 104 causes the impulse turbine 104 to rotate.

The spray of the wash liquid is oriented to contact the radial outer ends 108*a* of the buckets 108. The shape of the curved bottom of the buckets 108, as defined by the vanes 110, permits the wash liquid emitted from the nozzle (not shown) to contact the radial outer edges 108*a* and run down the curved bottom or curved vane 110. Further, the curvature of the vanes 110 is selected such that, as the wash liquid contacts the radial outer ends 108*a* and runs down the curved bottom defined by the vanes 110, the force of the wash liquid emitted upon the radial outer ends 108*a* allows the wash liquid to be re-directed back away from the vanes 110 or buckets 108. In an exemplary embodiment, the wash liquid can be re-directed 180 degrees from the point at which it contacted the bucket 108.

As the impulse turbine 104 rotates, the drive shaft 120 and, in turn, the drive gear 122 also rotate at the same rate of rotation as the impulse turbine 104. The drive gear 122 then transfers the energy and motion from the impulse turbine 104 to the gear train 124 which comprises a plurality of reduction gears 126. As the rotation from the impulse turbine 104 travels through the gear reducing gear train 124, the rate of rotation of the reduction gears 126 becomes reduced relative to the rate of rotation of the impulse turbine 104. The reduction gears 126 are further operably coupled to transfer rotation to the output gear 128. The output gear 128 then transfers rotation to the rotatable sprayer 28 by way of the mechanical coupling of the toothed outer portion 140 of the output gear 28 with the toothed ring 146 that is provided about the rotatable sprayer 28. The operable coupling of the output gear 128 with the rotatable sprayer 28 allows rotation of the rotatable sprayer 28 to be effected via the mechanical coupling with the rotatable impulse turbine 104.

The final rate of rotation at the rotatable sprayer 28 can be, by non-limiting example, between the range of 1 and 10 revolutions per minute, which is reduced from the rotational speed of the impulse turbine 104. It is contemplated herein that there could be provided a hydraulic drive 100 coupled with each rotatable sprayer 26, 28, 30, 32 within the dishwasher 10. It will be further understood that there can also be fewer hydraulic drives 100 than rotatable sprayers 26, 28, 30, 32, including only a single hydraulic drive 100. In the case that there are fewer hydraulic drives 100 than rotatable sprayers 26, 28, 30, 32, an additional series of gears 152 can be provided within the manifold 80 of the dishwasher 10 that serves to couple more than one rotatable sprayer 26, 28, 30, 32 to a single hydraulic drive 100.

Referring now to the operational fluid coupling of the liquid supply conduit 42 to the rotatable sprayer 28, wash liquid flows through the liquid supply conduit 42 to the manifold 80 and eventually at least a portion of the wash liquid flows over the impulse turbine 104 in the direction indicated by water flow arrow 132. The flow of the wash liquid over the turbine 104 in the direction of the water flow arrow 132 effects the rotation of the impulse turbine 104 in a in the same direction as indicated by the flow arrow 132. As the wash liquid flows over the impulse turbine 104 in the direction of the water flow arrow 132, the wash liquid will then flow out of the impulse turbine 104 as the impulse turbine 104 completes a rotation. The wash liquid flowing off of the impulse turbine 104 is directed into the treating chamber 16 of the tub 14 for recirculation.

The portion of the wash liquid that does not exit the manifold 80 to flow over the impulse turbine 104 will continue to flow through the manifold 80 along the flow path indicated by the arrow 148. The flow path indicated by the arrow 148 within the manifold 80 is fluidly coupled to the inlet 102 of the rotatable sprayer 28. In the case in which more than one rotatable sprayer 28 is arranged serially, a portion of the wash liquid can flow out all of the rotatable sprayers 28 that are connected to the manifold 80 and rotated in parallel via the additional series of gears 152. In this way, a portion of the wash liquid flows over the impulse turbine 104 to effect rotation of the impulse turbine 104, and, in turn, rotation of the rotatable sprayer 28 by way of the gearbox, while the remaining portion of the wash liquid within the manifold 80 flows into the rotatable sprayer 28 to be expelled from the nozzles 64 and be used to wash the dishes within the dishwasher 10.

In a traditional dishwasher, spray assemblies can be a significant contributor to space constraints. Using a rotatable sprayer in the form of a spray tube rather than a spray arm reduces the height of the spray assemblies and allows for more usable space in the dish racks. However, the drive system for the rotating spray tubes can be a significant contributor to cost and complexity of the dishwasher. Aspects of the present disclosure provide similar or improved performance to contemporary appliances by using the wash liquid itself to drive the rotation of the rotatable sprayers, eliminating the need for an electric motor or other actuator. The hydraulic drive described herein allows for compression of the water delivery device while exhibiting maximal efficiency. The invention of the present disclosure is also modular, allowing it to be placed on any tube wash manifold inside a dishwasher, or, even further, on any wash system component that needs to rotate.

To the extent not already described, the different features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of rotating a rotatable sprayer in a tub of a dishwasher, the method comprising:

supplying wash liquid to the rotatable sprayer by a liquid supply conduit having a manifold fluidly coupled to the rotatable sprayer;

splitting the supplied wash liquid into fluidly isolated first and second portions defined by the manifold;

supplying the first portion to the rotatable sprayer where the first portion is emitted through the rotatable sprayer; and supplying the second portion to a hydraulic drive that is rotationally coupled to the rotatable sprayer, whereby the second portion of the wash liquid drives rotation of the hydraulic drive to rotate the rotatable sprayer.

2. The method of claim 1 wherein the supplying wash liquid comprises emitting wash liquid from a nozzle directly onto the hydraulic drive.

3. The method of claim 2 wherein the emitting wash liquid from the nozzle directly onto the hydraulic drive comprises emitting the wash liquid directly onto buckets of an impulse turbine.

4. The method of claim 1 further comprising reducing the rotational speed of the rotatable sprayer from that of the hydraulic drive.

5. The method of claim 1 wherein the splitting of the wash liquid into first and second portions occurs upstream of the rotatable sprayer.

6. The method of claim 1 wherein the rotatable sprayer is drivingly coupled to a second rotatable sprayer wherein rotation of the rotatable sprayer rotates the second rotatable sprayer.

7. The method of claim 1 wherein the rotatable sprayer comprises a rotating tube.

8. The method of claim 7 wherein the rotating tube has a longitudinal axis and rotates about the longitudinal axis.

9. The method of claim 1 wherein the rotatable sprayer has a longitudinal axis and rotates about the longitudinal axis.

10. The method of claim 1 wherein the second portion is tangentially supplied to the hydraulic drive.

11. The method of claim 1 wherein the hydraulic drive rotates a gear train rotatably coupling the hydraulic drive to the rotatable sprayer.

12. The method of claim 11 wherein the gear train is a reduction gear train.

13. The method of claim 12 wherein the gear train is fluidly isolated from the second portion.

14. The method of claim 1 wherein the hydraulic drive comprises a rotatable turbine mechanically coupled to the rotatable sprayer wherein the second portion rotates the rotatable turbine to drive the hydraulic drive.

* * * * *